United States Patent [19]
Hild

[11] 4,197,031
[45] Apr. 8, 1980

[54] ADJUSTABLE MANHOLE COVER

[76] Inventor: Manfred Hild, Staibenaecker 24, 7 Stuttgart-I, B R D, Fed. Rep. of Germany

[21] Appl. No.: 941,799

[22] Filed: Sep. 12, 1978

[30] Foreign Application Priority Data

Sep. 14, 1977 [DE] Fed. Rep. of Germany ..... 2741346
Feb. 11, 1978 [DE] Fed. Rep. of Germany ..... 2805869

[51] Int. Cl.[2] ..... E02D 29/14
[52] U.S. Cl. ..... 404/26; 210/163
[58] Field of Search ..... 404/26, 25; 52/19, 20, 52/21; 210/164, 163, 165

[56] References Cited

U.S. PATENT DOCUMENTS

| | | | |
|---|---|---|---|
| 599,441 | 2/1898 | Dorr | 404/26 |
| 638,692 | 12/1899 | Banwell | 404/26 |
| 689,224 | 12/1901 | Pillsbury | 404/26 |
| 1,517,871 | 12/1924 | Thompson | 404/26 |
| 1,673,145 | 6/1928 | Gschwind | 404/26 |
| 1,712,267 | 5/1929 | Gschwind | 404/25 X |
| 3,215,052 | 11/1965 | Lindstad | 404/26 |
| 3,218,942 | 11/1965 | Raquet | 404/26 |

FOREIGN PATENT DOCUMENTS

| | | | |
|---|---|---|---|
| 2446417 | 8/1976 | Fed. Rep. of Germany . | |
| 201018 | 7/1923 | United Kingdom | 404/25 |
| 279338 | 10/1927 | United Kingdom | 404/25 |
| 442794 | 2/1936 | United Kingdom | 404/25 |
| 664152 | 1/1952 | United Kingdom | 404/25 |

*Primary Examiner*—Nile C. Byers, Jr.
*Attorney, Agent, or Firm*—Finnegan, Henderson, Farabow, Garrett & Dunner

[57] ABSTRACT

A vertically adjustable manhole cover assembly having a fixed annular support member, and a vertically adjustable annular member supported therein. The support member is provided with sets of graduated supports symmetrically mounted on its inner surface, and the adjustable member has sets of complementary graduated teeth on its outer surface which interact with the supports to rigidly support the adjustable member at a plurality of vertical levels. Grooves are also provided on the inside surface of the support member for accepting, and interlocking with, the teeth to prevent relative rotation of the annular members. The graduated teeth of the sets may include subsets of graduated steps.

18 Claims, 21 Drawing Figures

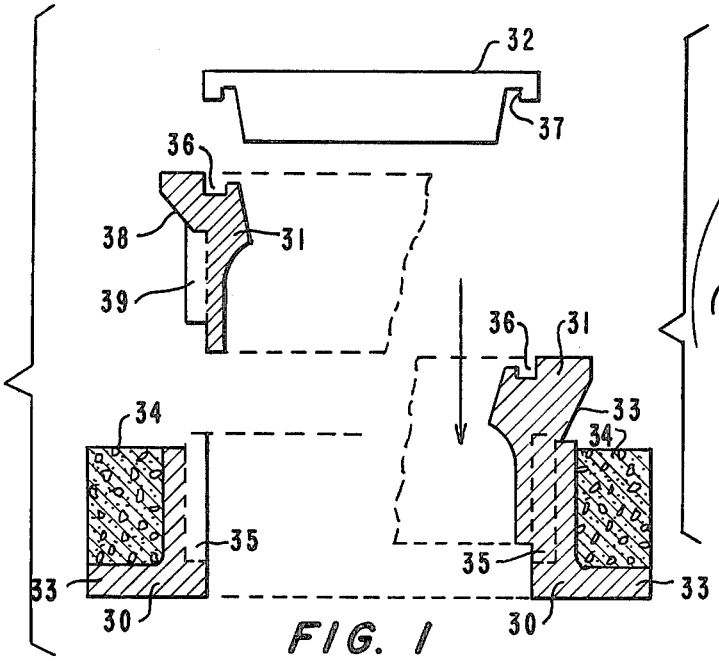
FIG. 1
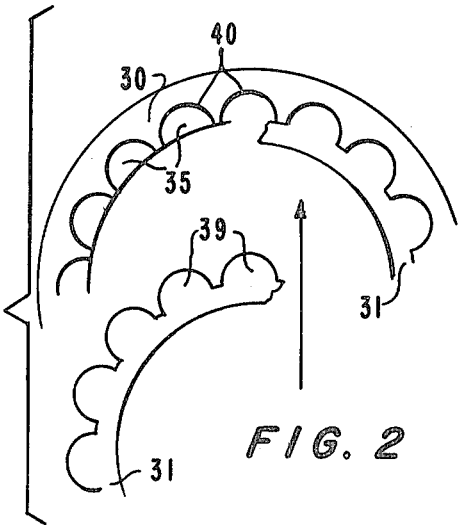
FIG. 2
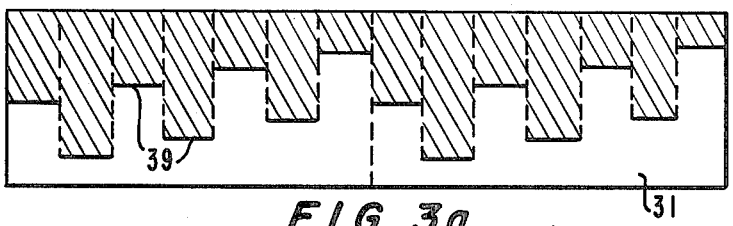
FIG. 3a
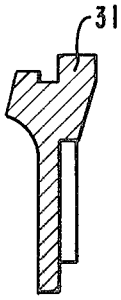
FIG. 3b
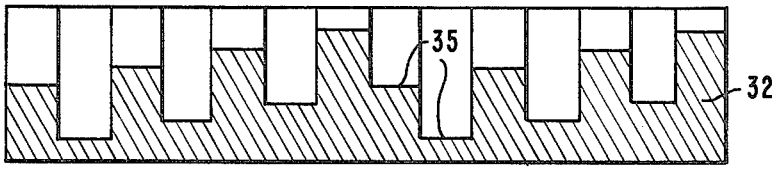
FIG. 4a
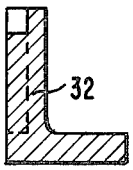
FIG. 4b
FIG. 5
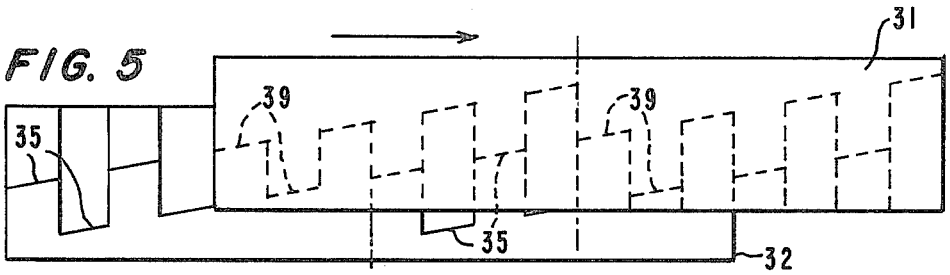

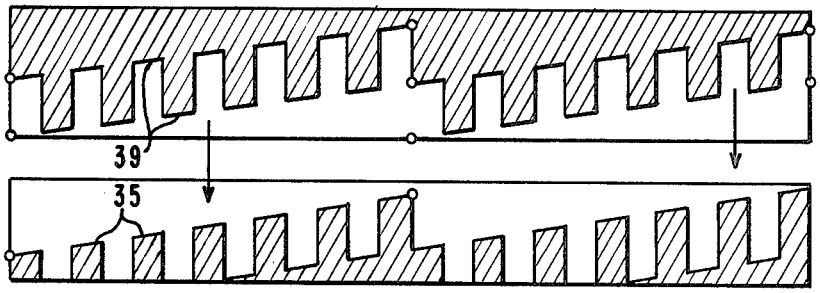
FIG. 6
FIG. 7
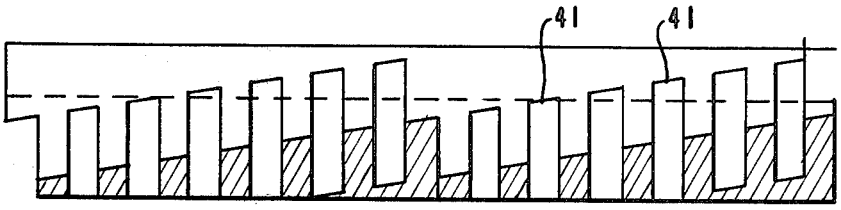
FIG. 8a
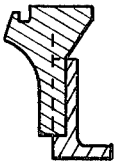
FIG. 8b
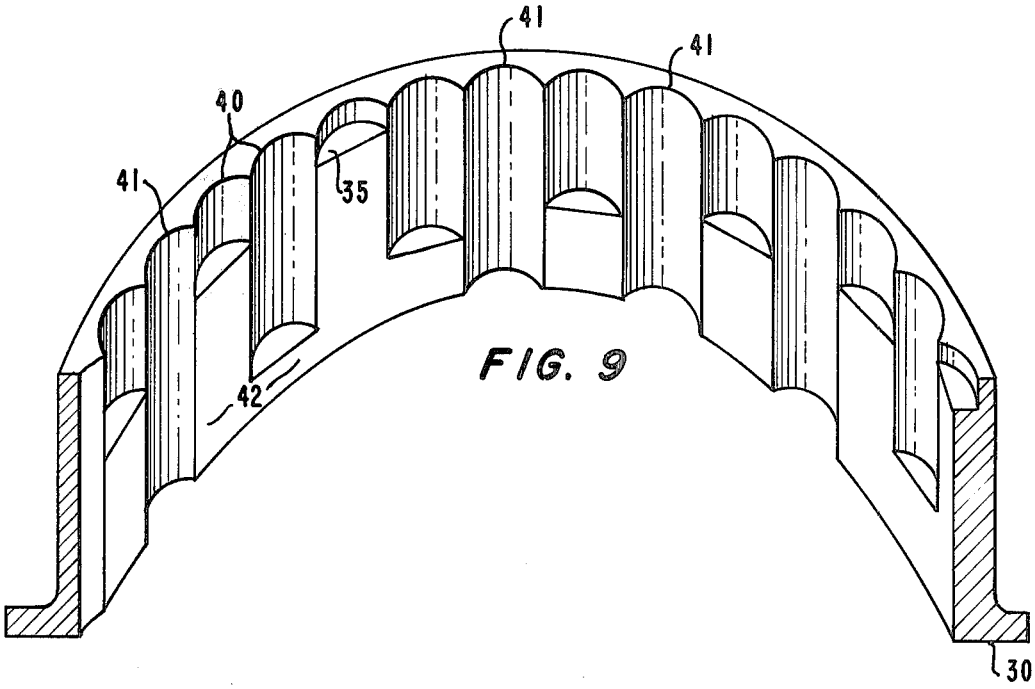
FIG. 9

ADJUSTABLE MANHOLE COVER

BACKGROUND OF THE INVENTION

This invention relates to manhole covers of the type widely used in street construction. More specifically, the invention relates to manhole covers which may be vertically adjusted by varying the height to conform the top surface of the cover to the level of a road.

Such manhole covers are normally installed flush with the road surface to provide a smooth transition between the road surface and the manhole cover thereby reducing road vibrations during vehicle travel. When it becomes necessary to repair or resurface the road, the height of the manhole cover may have to be adjusted to correspond to the new height of the paving. Raising of a conventional manhole cover involves extensive break-up of the road covering, removal and re-installation of the basic frame of the manhole cover, and re-paving of the area immediately surrounding the cover. This height readjustment involves a great deal of time, labor, and expense.

In an attempt to solve these problems, vertically adjustable manhole covers have been developed to allow easier and faster height adjustment of the manhole cover frame. One such structure, disclosed in West German Application No. P 2446717.2, utilizes a support member and an adjustable member with complementary steps along their circumferences. By moving the adjustable member to relocate its supporting positions to different steps of the support member, the adjustable member can be raised or lowered. This design requires each step of the support member to carry a corresponding step of the adjustable member resulting in quite heavy components. In addition, a separate pin must be provided to lock the adjustable member against rotation within the support member in the upper step positions. Without this locking pin the vibrations caused by vehicular traffic over the manhole cover could eventually cause the adjustable member to slip off its upper supporting steps to a lower position within the support member.

Accordingly, it is a primary object of this invention to provide a new and improved vertically adjustable manhole cover.

It is a further object of this invention to provide a vertically adjustable manhole cover with an adjustable member which is self-locking in each individual support position to prevent rotation relative to the support member.

Another object of the invention is to provide a vertically adjustable manhole cover which is easily castable and the support member is made lighter in weight.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

SUMMARY OF THE INVENTION

In accordance with the purposes of the invention, as embodied and broadly described herein, the adjustable manhole cover assembly of this invention comprises a fixed annular support member; graduated stop means mounted on the inside surface of the support member; a vertically adjustable annular member dimensioned for rotation within the periphery formed by the stop means; graduated tooth means mounted on the outer surface of the adjustable member, at least a portion of the tooth means being complementary to the stop means, and interacting with the graduated tooth means for rigidly supporting the adjustable member at a plurality of vertical levels; and socket means on the inner surface of the support member for accepting, and interlocking with, the graduated tooth means for preventing relative rotation of the annular members.

Preferably, the stop means includes at least one pair of sets of graduated supports of equal thickness symmetrically mounted on the inside surface of the support member. It is also preferred that the tooth means include at least one pair of sets of graduated teeth. The socket means preferably includes a plurality of grooves which receive the graduated teeth when the annular members are interlocked. It is also preferred that the manhole cover assembly includes spacer means between the supports for decreasing the weight of the support member. This spacer means may include non-supporting spaces complementary to a portion of the teeth when the members are interlocked.

The graduated teeth and the grooves may be semi-circular in shape, or may take, for example, the shape of rectangles, triangles or saw-teeth.

BRIEF DESCRIPTION OF THE DRAWINGS

The accompanying drawings, which are incorporated in and constitute a part of this specification, illustrate at least one embodiment of the invention and, together with the description, serve to explain the principles of the invention.

Of the drawings:

FIG. 1 is an exploded cross-sectional view of the basic components of the adjustable manhole cover assembly.

FIG. 2 is a partial cutaway plan view showing the mating relationship of the support member to the adjustable member and an embodiment of the invention with semi-circular teeth.

FIG. 3*a* is a flattened view of a portion of the exterior of the adjustable member showing the stepped support planes formed by the graduated teeth. A cross-section (FIG. 3*b*) is shown on the right.

FIG. 4*a* is a similar flattened view of a portion of the interior of the support member showing the geometric development of the rising stepped planes formed by the supports. A cross-section FIG. 4*a* is shown on the right.

FIG. 5 is a flattened view of a portion of the support member and adjustable member showing how the adjustable member is raised when the teeth are relocated to adjacent supports in the direction of the arrow.

FIG. 6 is a flattened view of a portion of the exterior of the adjustable member similar to FIG. 3 showing the support planes formed by the graduated teeth.

FIG. 7 is a flattened view of a portion of the interior of the support member of the preferred embodiment of the invention in which the supports are separated by non-supporting spaces.

FIG. 8*a* is a flattened view similar to FIGS. 6 and 7 showing the adjustable member supported by the support member.

FIG. 8*b* shows a cross-section of the view in FIG. 8*a*.

FIG. 9 is a perspective view of a portion of the support member of the preferred embodiment.

DESCRIPTION OF THE PREFERRED EMBODIMENTS

Figure 10:
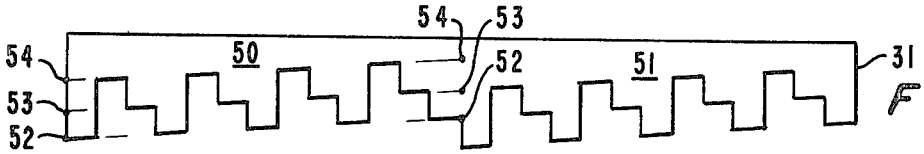
FIG. 10 is a flattened view of a portion of the exterior of the adjustable member showing an alternative embodiment having sets of teeth with three different graduated levels in each tooth.

Reference will now be made in detail to the present preferred embodiment of the invention, an example of which is illustrated in the accompanying drawings. Referring now to FIGS. 1 and 2, it may be seen that the manhole cover assembly provides a rapid and simple means for adjusting the height of a manhole cover. In accordance with the invention, the manhole cover assembly generally includes a fixed annular support member 30. As embodied herein, the annular support member has a circular design corresponding to the normal shape of a manhole opening. Preferably, the support member 30 is formed of cast material, and has an outwardly extending flange 33 for securing the support member into position with concrete or other suitable fill material 34.

In accordance with the invention, the annular support member includes graduated stop means mounted on the inside surface thereof. As here embodied, the stop means includes at least one pair of sets of graduated supports 35 of equal thickness symmetrically mounted on the inside surface of the support member.

In accordance with the invention, a vertically adjustable annular member 31 is also provided. The adjustable member is dimensioned for rotation within the periphery formed by the stop means. As here embodied, the adjustable member 31 is circular in shape and has a notch 36 about the top end thereof for receiving a similar notched portion 37 of a lid 32. The outer surface 38 of the adjustable member is slanted outward in a wedge-shape. Preferably, the member 31 is also formed of a cast material.

In accordance with the invention, graduated tooth means are mounted on the outer surface of the adjustable member. At least a portion of the tooth means are complementary to the stop means on the support member. As here embodied, the tooth means includes at least one pair of sets of graduated teeth 39, symmetrically mounted on the outer surface of the adjustable member 31. As best shown in FIGS. 3, 4 and 5, the graduated teeth 39 interact with complementary supports 35 to rigidly support the adjustable member at a plurality of vertical levels. When the adjustable member 31 is raised from the support member and rotated in the direction of the arrow in FIG. 5, the vertical level of the adjustable member with respect to the support member, is raised in a discrete amount.

In accordance with the invention, socket means are provided on the inner surface of the support member for accepting, and interlocking with, the graduated tooth means to prevent relative rotation of the annular members. As here embodied, the socket means includes a plurality of grooves 40, best shown in FIG. 9. When the annular members are placed in the interlocked position, each of the graduated teeth 39 on the adjustable member 31 extends into one of the grooves 40.

Figure 17:
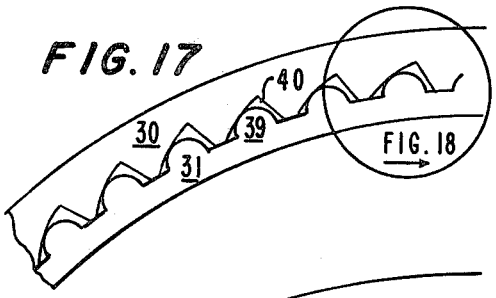
FIG. 17 is a partial plan view of an alternative embodiment of the invention.
Figure 18:
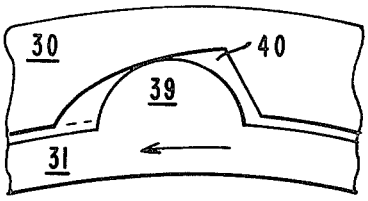
FIG. 18 is an exploded view of the graduated tooth design of the embodiment in FIG. 17.
Figure 19:
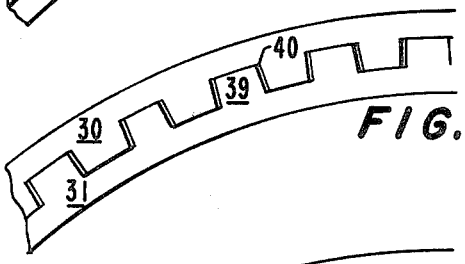
FIGS. 19, 20, and 21 are partial plan views of three other alternative embodiments in which the graduated teeth are rectangular, triangular and sawtooth-shaped, respectively.
Figure 20:
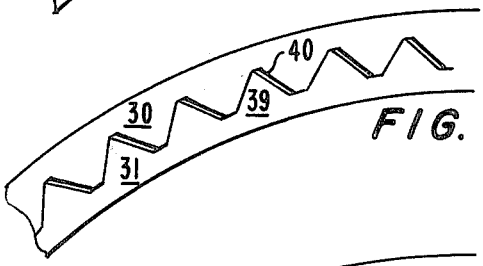
Figure 21:
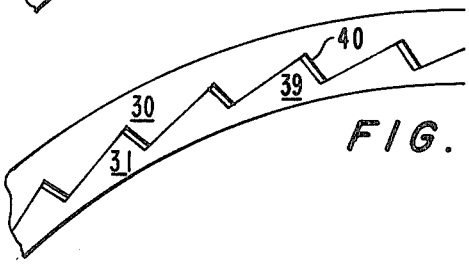

Preferably, the graduated teeth 39 and the grooves 40 are semi-circular in shape as shown in FIG. 2. Alternatively, the teeth and grooves may be rectangularly shaped, as shown in FIG. 19, triangularly shaped as shown in FIG. 20, or saw-tooth shaped as shown in FIG. 21. The outer edges of the grooves may be rounded as shown in FIGS. 17 and 18 in order to facilitate removal and reinsertion of the adjustable member 31.

Preferably, the adjustable manhole cover assembly also includes spacer means between the supports for decreasing the weight of the support member. As here embodied, the spacer means includes nonsupporting spaces 41, complementary to at least a portion of the teeth 39 when the annular members 30 and 31 are in the interlocked position. As shown in FIGS. 6 to 9, not every one of the graduated teeth 39 interacts with a corresponding support 35, some of the teeth 39 being located in nonsupporting spaces 41. This configuration allows the weight of the support member to be substantially reduced while maintaining sufficient bearing capacity for vehicular traffic.

As also shown in FIG. 9 at numeral 42, the sets of graduated supports may be interconnected at different vertical levels.

Figure 11:
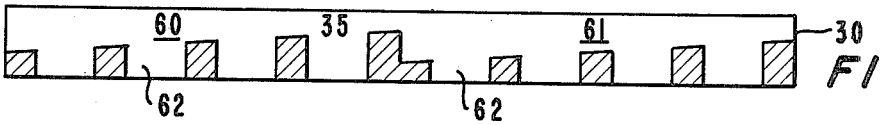
FIG. 11 is a flattened view of a portion of the interior of the support member showing the arrangement and spacing of the supports to complement the teeth of FIG. 10.
Figure 12:
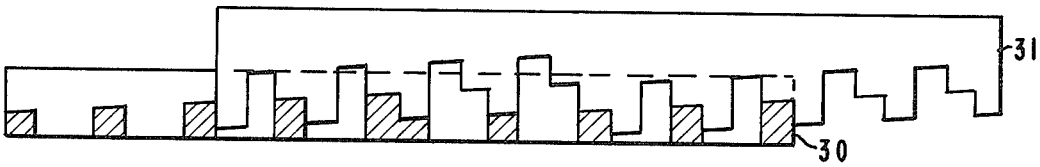
FIG. 12 is a flattened view similar to FIGS. 10 and 11 showing the relationship of the annular members having teeth with three different graduated levels.

As here embodied, the graduated teeth of the sets may also be formed to provide a plurality of subsets, each of the subsets forming a separate rising series of steps. FIG. 10 illustrates one such embodiment showing two sets of teeth 50 and 51, each set being subdivided into three series of steps. Set 50 is subdivided, for example, into series 52, 53 and 54 in FIG. 10. The corresponding supports for such an embodiment are formed in sets 60 and 61 as shown in FIG. 11. Each two of the adjacent individual supports 35 are separated by spaces 62 corresponding to the width of two steps. FIG. 12 shows the interlocking relationship of this multiple series construction.

Figure 13:
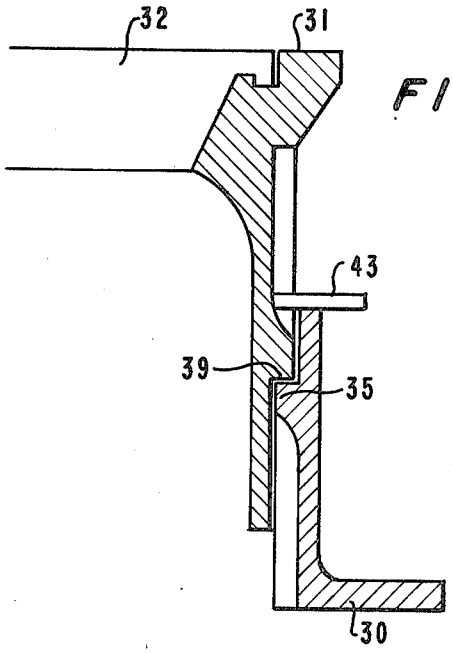
FIG. 13 is a cross-section of another alternative embodiment having wedge-shaped teeth and supports and a protective ring.
Figure 14:
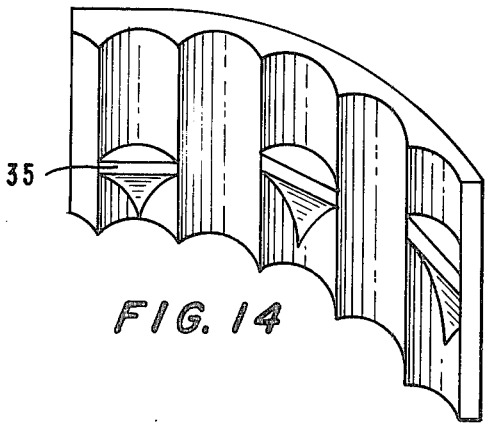
FIG. 14 is a perspective view of a segment of the support member of the FIG. 13 embodiment.
Figure 15:
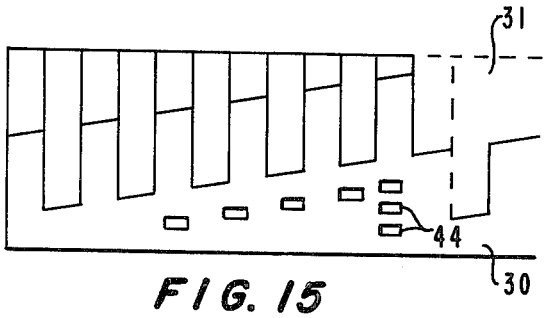
FIG. 15 is a flattened view of the interior of the support member showing the location of the crowbar recesses.
Figure 16:
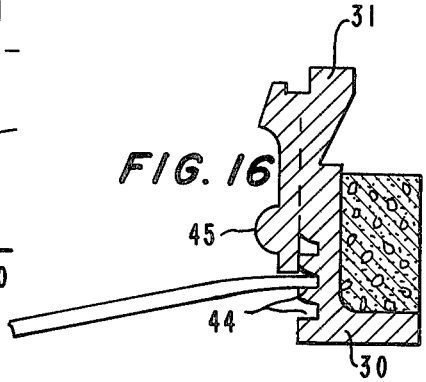
FIG. 16 is a cross-section of the cover showing a crowbar inserted in a recess.

Alternatively, the supports 35 and the teeth 39 may be formed in the axial direction in the shape of wedges as shown in FIGS. 13 and 14. This construction also substantially reduces the weight of both annular members. Preferably, a protective annular ring 43 is included with this embodiment. The ring 43 seals the space above the wedge-shaped teeth 39 on the adjustable member 31.

The support member may also be provided with recesses 44 in the areas below the support surfaces for facilitating, loosening and removal of the ring by means of a crowbar or other pointed object. In addition, projections 45 may be formed on the adjustable member 31. These projections provide an easy target for striking the adjustable member with a hammer or other heavy object to assist in loosening that member.

In addition, the annular members may be provided with visible height adjustment markings (not shown) which provide a ready reference as to the exact increase in vertical level which will provided by a given change in relative orientation of the annular members.

As may be readily seen by those skilled in the art, the manhole cover assembly of the present invention could also be applied to any system of vertically adjustable members when an adjustment in height or length is required between two or more rotatable parts. In addition, the design of the graduated teeth and supports may be easily reversed, the teeth being formed on the support member and the supports extending from the support member as teeth and the adjustable member having complementary supports thereon. Also, a plurality of annular members may be arranged one within the other, the intermediary members having teeth on the outer surface and supports on the inner surface thereof for applications requiring appreciable adjustments in height.

It will be apparent to those skilled in the art that various modifications and variations could be made in the manhole cover assembly of the invention without departing from the scope or spirit of the invention.

What is claimed is:

1. A vertically adjustable manhole cover assembly comprising:

a fixed annular support member;

graduated stop means mounted on the inside surface of said support member;

a vertically adjustable annular member dimensioned for rotation within the periphery formed by said stop means;

graduated tooth means mounted on the outer surface of said adjustable member, at least a portion of said tooth means being complementary to said stop means;

said stop means interacting with said graduated tooth means for rigidly supporting said adjustable member at a plurality of vertical levels;

socket means on the inner surface of said support member for accepting, and interlocking with, said graduated tooth means for preventing relative rotation of said annular member; and a cover member supported on said adjustable member.

2. The adjustable manhole cover assembly of claim 1 wherein said stop means includes at least one pair of sets of graduated supports of equal thickness symmetrically mounted on the inside surface of said support member, and said tooth means includes at least one pair of sets of graduated teeth.

3. The adjustable manhole cover assembly of claim 2 wherein each of said sets of graduated teeth include subsets of graduated steps.

4. The adjustable manhole cover assembly of claim 2 wherein said socket means includes a plurality of grooves, individual ones of said graduated teeth extending into each of said grooves when said annular members are in the interlocked position.

5. The adjustable manhole cover assembly of claim 4 also including spacer means between said supports for decreasing the weight of said support member, said spacer means includes non-supporting spaces complementary to at least a portion of said teeth when said members are in the interlocked position.

6. The adjustable manhole cover assembly of claim 5 wherein said graduated teeth and said grooves are semicircular in shape.

7. The adjustable manhole cover assembly of claim 6 wherein the outer edges of said grooves are rounded to facilitate removal and reinsertion of said adjustable member.

8. The adjustable manhole cover assembly of claim 5 wherein said graduated teeth and said grooves are triangular in shape.

9. The adjustable manhole cover assembly of claim 5 wherein said graduated teeth and said grooves are rectangular in shape.

10. The adjustable manhole cover assembly of claim 5 wherein said graduated teeth and said grooves are sawtooth in shape.

11. The adjustable manhole cover assembly of claim 5 wherein said graduated teeth and said supports are wedge-shaped in the axial direction.

12. The adjustable manhole cover assembly of claim 11 also including a protective annular ring for sealing the space above said wedge-shaped teeth on said adjustable member.

13. The adjustable manhole cover assembly of claim 1 also including a lid supported on said adjustable member.

14. The adjustable manhole cover assembly of claim 13 wherein said lid and said adjustable member are integral.

15. The adjustable manhole cover assembly of claim 5 wherein said support member includes at least one recess for use in loosening said adjustable member.

16. The adjustable manhole cover assembly of claim 15 wherein said adjustable member also includes at least one protrusion on the inner surface thereof for use in loosening said adjustable member.

17. The adjustable manhole cover assembly of claim 2 wherein the complementary surfaces of said graduated teeth and said graduated supports are slanted.

18. The adjustable manhole cover assembly of claim 2 wherein the portion of said tooth means complementary to said stop means comprises every other tooth.

* * * * *